US006966769B2

(12) United States Patent
Elvander et al.

(10) Patent No.: US 6,966,769 B2
(45) Date of Patent: Nov. 22, 2005

(54) GASEOUS OXYGEN RESONANCE IGNITER

(75) Inventors: Joshua E. Elvander, Los Angeles, CA (US); Steven C. Fisher, Simi Valley, CA (US); Shinjiro Miyata, Malibu, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/818,645

(22) Filed: Apr. 5, 2004

(65) Prior Publication Data

US 2005/0221245 A1 Oct. 6, 2005

(51) Int. Cl.[7] ..... F23Q 13/00

(52) U.S. Cl. ..... 431/267; 431/263; 431/350; 431/354

(58) Field of Search ..... 431/1, 19, 114, 431/263, 267, 350, 354

(56) References Cited

U.S. PATENT DOCUMENTS

| | | | | |
|---|---|---|---|---|
| 3,811,359 | A * | 5/1974 | Marchese et al. | 89/1.813 |
| 4,036,581 | A * | 7/1977 | Keyser et al. | 431/267 |
| 5,109,669 | A | 5/1992 | Morris et al. | |
| 5,938,428 | A * | 8/1999 | Palmer et al. | 431/255 |
| 6,272,845 | B2 | 8/2001 | Kessaev et al. | |
| 2004/0131986 | A1 * | 7/2004 | Stalder et al. | 431/278 |
| 2005/0053876 | A1 * | 3/2005 | Joos et al. | 431/6 |

FOREIGN PATENT DOCUMENTS

| | | | | |
|---|---|---|---|---|
| RU | 2053445 C1 * | 1/1996 | | F23D 11/34 |
| RU | 2057996 C1 * | 4/1996 | | F23Q 13/00 |
| RU | 2064132 C1 * | 7/1996 | | F23Q 13/00 |
| RU | 2067725 C1 * | 10/1996 | | F23D 11/34 |
| RU | 2079055 C1 * | 5/1997 | | F23Q 13/00 |
| SU | 1322018 A * | 7/1987 | | F23Q 13/00 |
| SU | 1333974 A * | 8/1987 | | F23Q 13/00 |
| SU | 1537967 A * | 1/1990 | | F23Q 13/00 |
| SU | 1657883 A * | 6/1991 | | F23Q 13/00 |

OTHER PUBLICATIONS

Shapiro, A.H., "On the Maximum Attainable Temperature in Resonance Tubes," Journal of the Aero/Space Sciences, pp 66-67, Jan. 1960.

Thompson, P.A., "Jet-Driven Resonance Tube," AIAA Journal 2, pp 1230-1233 (1964).

McAlevy III, R.F. and Pavlak, A., "Tapered Resonance Tubes: Some Experiments," AIAA Journal 8, pp 571-572 (1970).

Phillips, B.R. and Pavli, A.J., "Resonance Tube Ignition of Hydrogen-Oxygen Mixtures," NASA TN D-6354, May 1971.

Marchese, V.P., "Development and Demonstration of Flueric Sounding Rocket Motor Ignition," NASA CR-2418, Jun. 1974.

* cited by examiner

*Primary Examiner*—Monica S. Carter
*Assistant Examiner*—James G. Barrow
(74) *Attorney, Agent, or Firm*—Felix L. Fischer

(57) ABSTRACT

A gaseous oxygen resonance igniter includes a body with a first inlet for gaseous oxygen incorporating a supersonic nozzle. An outlet from the body incorporates an orifice of predetermined size to maintain a desired pressure in the body. An aperture in the body opposite the first inlet provides a port to a ceramic resonance cavity. A ceramic bleed disc is engaged at a second end of the resonance cavity. An end cap incorporates a plenum adapted to receive high temperature oxygen flow from the resonance cavity through the bleed disc. An exhaust port is connected to the plenum for the high temperature oxygen which flows to a mixing chamber which introduces pilot fuel for ignition as a combustion initiation torch.

20 Claims, 3 Drawing Sheets

GASEOUS OXYGEN RESONANCE IGNITER

BACKGROUND OF THE INVENTION

1. Field of the Invention

This invention relates generally to the field of resonance heating of gas for propellant and oxidizer ignition and, more particularly, to a system for resonance heating of oxygen employing a ceramic resonance cavity and hot gas bleed withdrawal for generating an ignition torch.

2. Description of the Related Art

Resonance ignition is based on a phenomenon known as gasdynamic resonance, wherein supersonic, underexpanded flow is axially directed from a supersonic nozzle 2 at a tube with a closed end, referred to as a resonance cavity 4, causing an oscillating detached bow shock to form in a chamber 6 upstream of the entrance to the cavity as shown in FIG. 1. Gas then exits the chamber through a restricting orifice 8. Reflected shocks from the end of the resonance cavity couple and reinforce the detached bow shock, interacting with the flow within the tube such that the successive cycles of shocks cause the formation of a series of unstable zones of elevated pressure within the tube. These zones can produce temperature increases up to ~2000 R for certain gases. The physical criteria for the interaction are defined by "d" the diameter of the supersonic inlet nozzle, "G" the distance between the nozzle throat and the mouth of the resonance cavity and "$D_{MC}$" is the diameter of the throat of the restriction orifice.

Gasdynamic resonance was first described by Hartmann in 1931, who was investigating acoustics and overlooked the associated temperature increase. The term resonance tube was first coined by Sprenger in 1954, who rediscovered the phenomenon and observed the conditions that affect temperature increase (Sprenger once demonstrated the temperature increase by directing supersonic, underexpanded flow at a blind cavity in a piece of wood, which would catch fire after a very brief period). Theories for the temperature increase were put forth in 1959 by Wilson and Resler, and in 1960 by Shapiro. Shapiro, A. H., "On the Maximum Attainable Temperature in Resonance Tubes," Journal of the Aero/Space Sciences, 66–67, January 1960. The pressure flowfield was described by Thompson in 1960 and his student Kang in 1964. Thompson, P. A., "Jet-Driven Resonance Tube," AIAA Journal 2, 1230–1233 (1964). In 1970, Pavlak and his student McAlevy noted that using tapered tubes decreased the time to elevate the temperature of the gas. McAlevy III, R. F. and Pavlak, A., "Tapered Resonance Tubes: Some Experiments," AIAA Journal 8, 571–572 (1970). All of this initial work was academic in nature, however, and did not investigate applications of the phenomena to existing technology. In 1967, Conrad and Pavli of the NASA Lewis Research Center suggested using gasdynamic resonance to ignite liquid rocket engines. This work was followed by an investigation by Phillips and Pavli in 1971 to determine what geometric parameters influenced the maximum attainable temperature and response time. Phillips, B. R. and Pavli, A. J., "Resonance Tube Ignition of Hydrogen-Oxygen Mixtures," NASA TN D-6354, May 1971. At around the same time (1968–1974), Vincent Marchese of the Singer Company investigated applying the concept to ignition of small solid rockets using a hand-powered pneumatic pump, under various contracts with the U.S. Army, NASA, and the Ballistic Missile Defense Organization. Marchese, V. P., "Development and Demonstration of Flueric Sounding Rocket Motor Ignition," NASA CR-2418, June 1974. Marchese used the term "pneumatic match" to refer to the resonance igniter, and performed an extensive parametric study of the resonance cavity geometry.

More recently, a "Passive Self-Contained Auto Ignition System," has been disclosed in U.S. Pat. No. 5,109,669, issued May 5, 1992 to Donald Morris and Gary Briley. Additionally, U.S. Pat. No. 6,272,845 B2 entitled "Acoustic Igniter and Ignition Method for Propellant Liquid Rocket Engine" issued Aug. 14, 2001 to Khoze Kessaev, Vasili Zinoviev, and Vladimir Demtchenko.

It is desirable to employ the simplicity of resonance heating for an ignition system without requiring cooling of the resonance cavity. Further, it is desirable to employ oxygen as the resonating fluid to allow use with various fuels including liquid fuels.

SUMMARY OF THE INVENTION

A gaseous oxygen resonance igniter according to the present invention includes a body with a first inlet for gaseous oxygen incorporating a supersonic nozzle. An outlet from the body incorporates an orifice of predetermined size to maintain a desired pressure in the body. An aperture in the body opposite the first inlet provides a port to a ceramic resonance cavity engaged at a first end. A ceramic bleed disc is engaged at a second end of the resonance cavity. An end cap incorporates a plenum adapted to receive high temperature oxygen flow from the resonance cavity through the bleed disc. An exhaust port is connected to the plenum for the high temperature oxygen which flows to a mixing chamber which introduces pilot fuel for ignition as a combustion initiation torch.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 2:
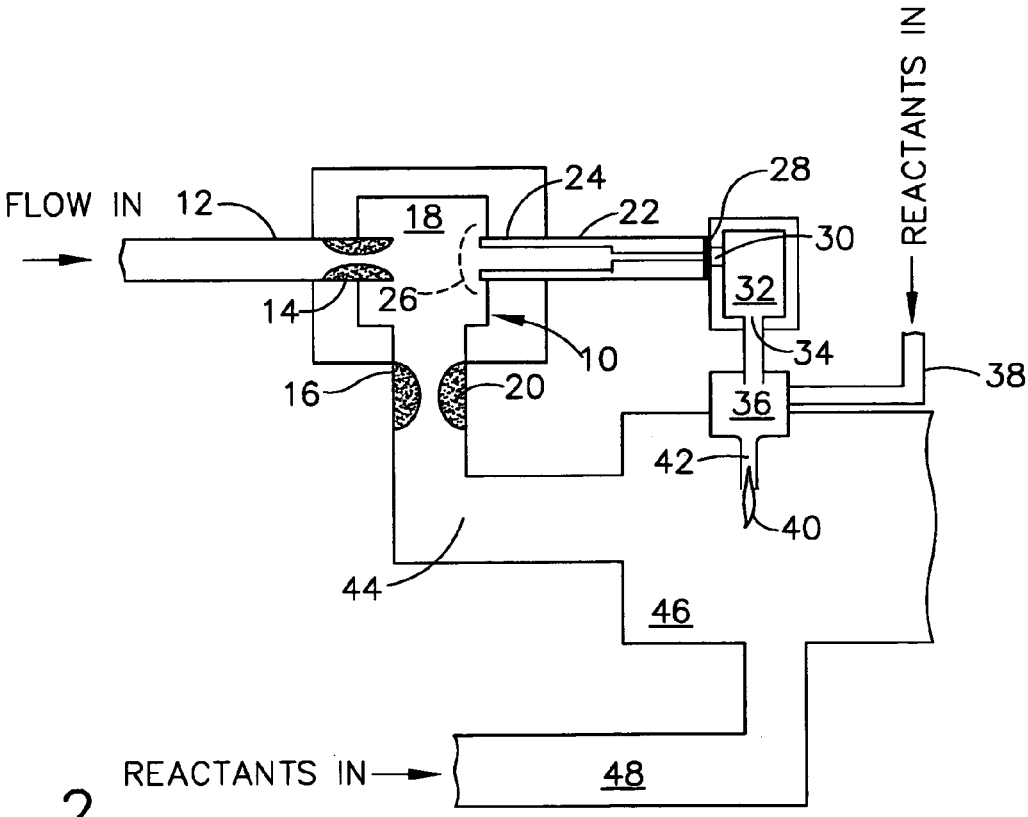
FIG. 2 is a schematic block diagram of a resonance ignition system incorporating the present invention.

Referring to the drawings, FIG. 2 shows the basic arrangement of a resonance igniter employing the present invention. A body 10 has an oxygen inlet 12 incorporating a supersonic nozzle 14. An outlet 16 from the chamber 18 in the body employs an orifice 20 to maintain pressure in the body at a predetermined level, as will be described in greater detail subsequently. A resonance cavity 22 is engaged within an aperture 24 in the body opposite the inlet. Oxygen entering through the supersonic nozzle as underexpanded flow is axially directed at the resonance cavity, causing an oscillating detached bow shock 26 to form upstream of the entrance. Reflected shocks from the end of the resonance cavity couple and reinforce the detached bow shock, interacting with the flow within the resonance cavity such that the successive cycles of shocks cause the formation of a series of unstable zones of elevated pressure within the resonance cavity. These zones can produce temperature increases up to 2000 R.

A bleed disc 28 having a bleed orifice 30 terminates the resonance cavity at a second end opposite the entrance. High temperature oxygen from the resonance cavity flows through the bleed orifice into a plenum 32. An exhaust port 34 in the plenum directs the high temperature oxygen into a pilot mixing chamber 36 where a reactant source 38 provides pilot fuel to be ignited to create a torch 40 at an exhaust orifice 42 from the pilot mixing chamber. The main flow of oxygen exiting the body through the orifice 20 is routed through manifold 44 to a second mixing chamber 46 where further reactant charge supplied through manifold 48 is entrained to be ignited with the oxygen main flow. Additional oxygen and reactant can be mixed into the second mixing chamber or subsequently entrained in downstream mixing chambers depending on application requirements. The use of oxygen as the working gas for the resonance heating allows a variety of fuels to be autoignited with the oxygen. Hydrogen, methane, ethane, propane, and other hydrocarbon fuels could be utilized.

Figure 1:
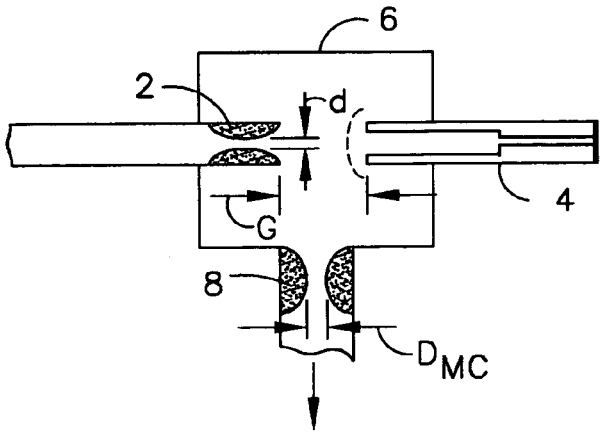
FIG. 1 (PRIOR ART)
FIG. 1 is schematic diagram of a basic gasdynamic resonance heating cavity as known in the prior art.
Figure 3:
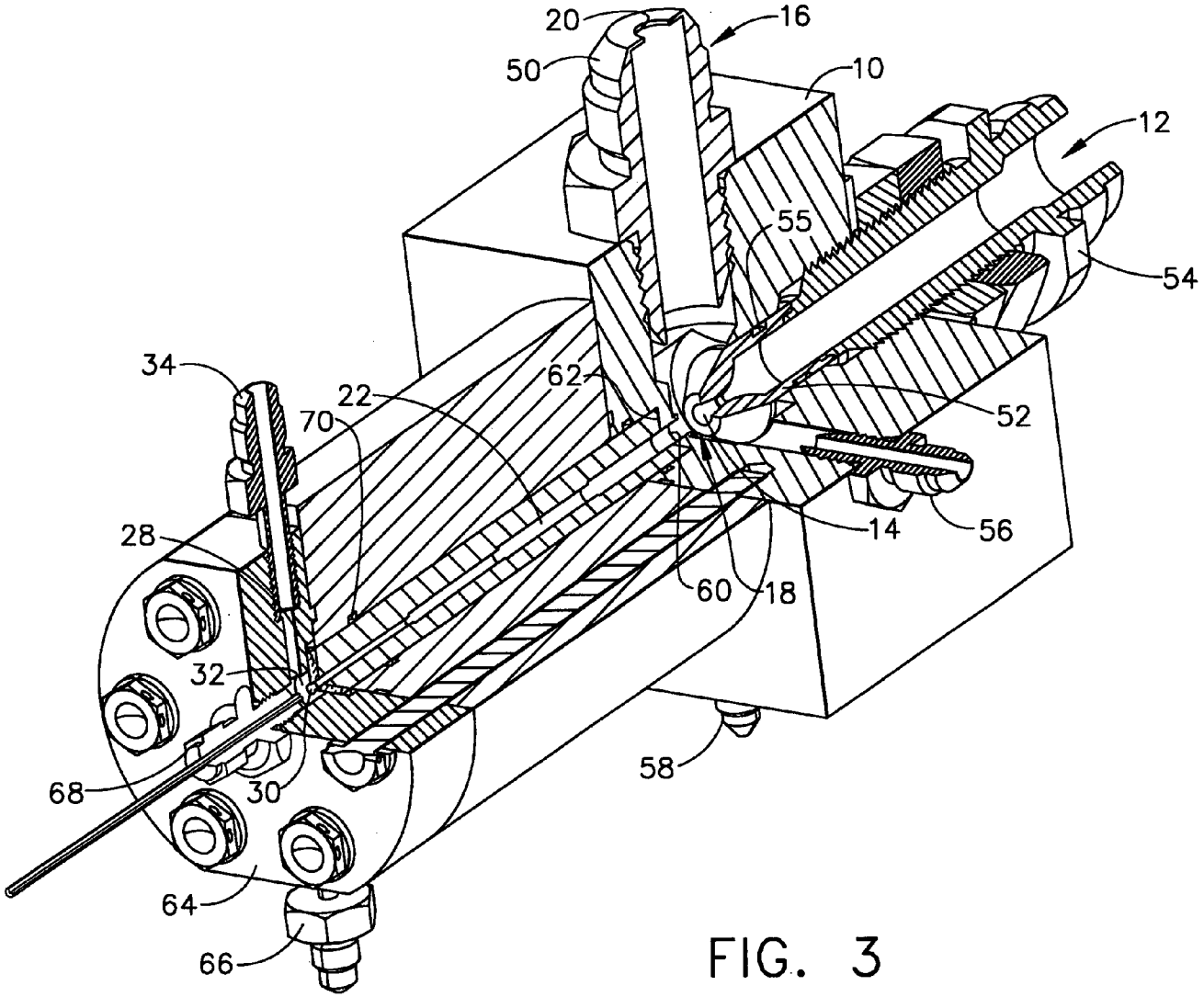
FIG. 3 is a cut-away isometric view of an embodiment of the components of the resonance heating system of the present invention.
Figure 4:
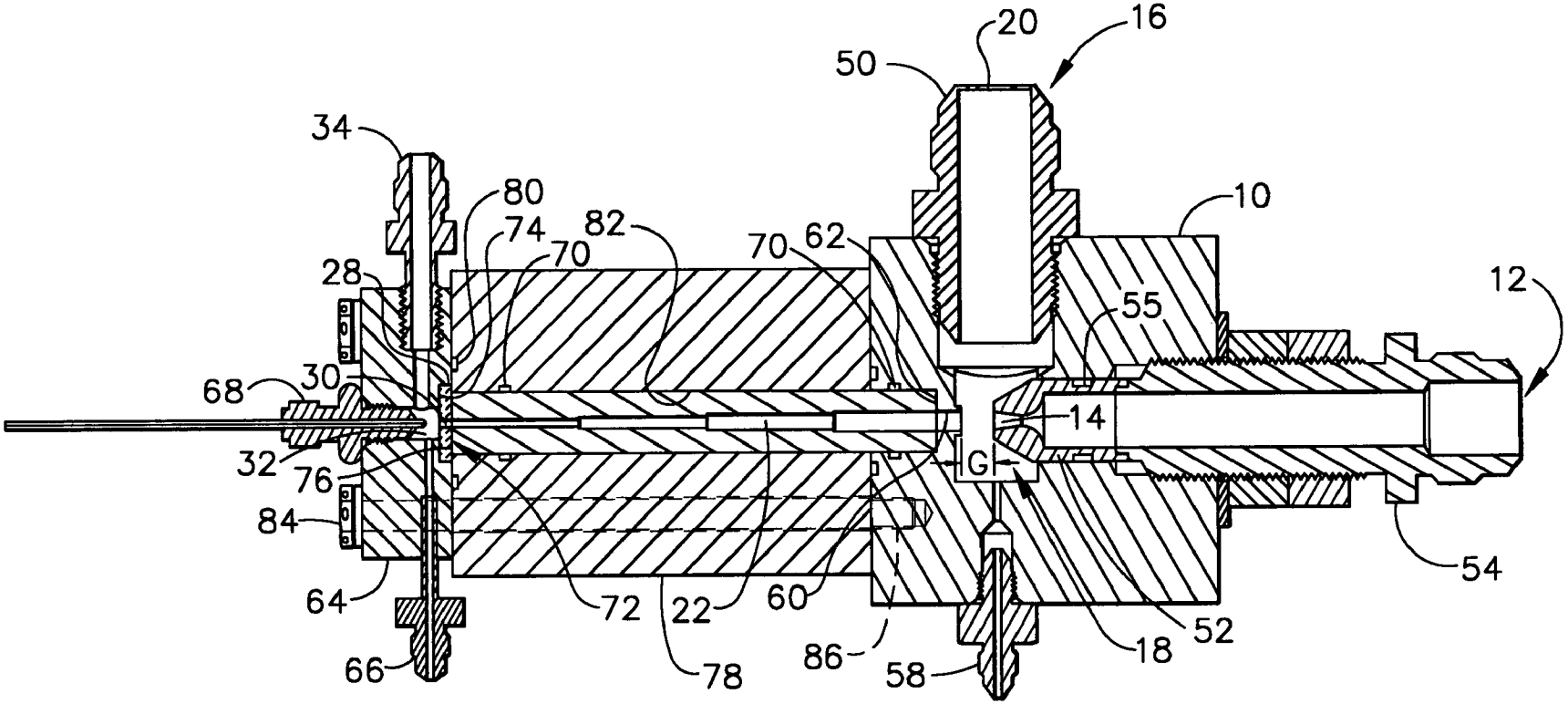
FIG. 4 is a side section view of the embodiment of FIG. 3.

Turning now to FIGS. 3 and 4, an exemplary embodiment employing the invention in a test configuration is shown. Design parameters for the basic elements as shown in FIG. 1 for a resonance system are shown in Table 1 for the configuration shown.

Table 1: Design Conditions and Variables for Gaseous Oxygen Resonance Igniter.

TABLE 1

Design conditions and variables for gaseous oxygen resonance igniter.

| Design Conditions | |
|---|---|
| $P_{Inlet}$ (Pressure Inlet) | 200 psia |
| M-dot$_{Inlet}$ (Inlet Mass Flow Rate) | 0.064 lbm/s |
| $T_{Inlet}$ (Inlet Temperature) | 520 R |
| M-dot$_{Bleed\ disk}$ (Mass Flow Rate of Bleed Disk) | $3.2 \times 10^4 - 1.28 \times 10^5$ lbm/s |
| **Variables** | |
| G/d | 1.9–3.9 |
| $P_{Inlet}/P_{Mixing\ Chamber}$ | 4.5–6.0 |
| Resonance Cavity L/d | 9.6–25.2 |

The embodiment incorporates a body 10 with an inlet 12 having a nozzle 14 which is adjustable as will be described in greater detail subsequently, a chamber 18, and a cylindrically walled resonance cavity 22. The flow from the chamber exits through the orifice 20 (having a diameter of 0.28-in. acting as a choked flow supersonic nozzle) in the outlet of the chamber, which can be easily removed and replaced with an orifice of different size (exemplary alternative orifice diameters, 0.30-in., and 0.32-in, corresponding to $P_{inlet}/P_{mixing\ chamber}$ of 5.25 and 6.0 respectively, in addition to $P_{inlet}/P_{mixing\ chamber}$ of 4.5 with the initial orifice). The orifice is located in a threaded piece 50, which when removed from the body, allows the gap G to be measured. In the embodiment in FIGS. 3 and 4, the supersonic nozzle having a diameter of 0.130-in. is machined into a nipple 52 extending from a threaded lug 54. Rotating the threaded lug allows the gap G from the nozzle throat to the entrance to the resonance cavity to be varied from 0.25–0.50 in., corresponding to the desired G/d ratios of 1.9–3.9. O-ring 55 located in the constant area section between the nozzle throat and threaded section seal the inlet of the chamber.

In addition to the openings for the inlet, outlet and resonance cavity, two ports 56, 58 are present to accommodate a pressure transducer and a thermocouple. The first 0.206 in. of the resonance cavity is a hole 60 in recess 62 of the body itself, to allow for proper placement and pressure sealing of the cylindrically walled ceramic resonance cavity. A first end of the cylindrical resonance cavity is received in the recess. Three cavities are employed for alternative embodiments, of lengths 4.05-in., 2.33-in., corresponding to L/d ratios of 9.6, 15.1, and 25.2. The resonance cavities each had four steps of equal length and diameters of 0.168-in., 0.100-in., and 0.026-in., respectively, moving aft.

The highest temperature gas created by the resonance cavity is present at the end opposite the body. A small amount of oxygen flow bleeds from the resonance cavity through a bleed orifice 30 in a ceramic bleed disc 28. Bleed discs of varying diameter (0.026-in., 0.037-in., and 0.052-in.) are employed in alternate embodiments for varied flow. The bleed flow enters into a small plenum 32 in an end cap 64. The plenum has two ports perpendicular to the flow, an exhaust port 34 for the hot gas and a pressure transducer port 66. At the other end of the plenum is a threaded thermocouple port 68. The materials selected for the embodiment shown were driven by simplicity and cost. All the metal components are fabricated from stainless steel. The resonance cavity operating environment necessitates ceramic material capable of high thermal loading. Aluminum silicate was selected for the ceramic elements of the embodiment shown. Alternative ceramics for various applications include silicon nitride, carbon/silicon carbide, glass-mica, aluminum/zirconia, and mullite.

The bleed disks and a portion of the plenum are subjected to nearly the same thermal loading as the resonance cavity. Aluminum silicate is employed for the bleed disks in the embodiment shown; however, the alternative ceramics identified can be employed. To seal the ceramic-metal interface, grafoil (graphite gasket material) is used in ring seals 70 for the cylindrical ceramic resonance cavity.

Since only a small section of the plenum is exposed to the hot gas in the embodiment shown to accommodate the thermocouple fittings and exhaust nozzle with screw threads which can be difficult to machine out of ceramic, the end cap containing the plenum is machined out of stainless steel. The portion of the plenum exposed to the hot gas is coated with a thermal barrier coating, such as zirconia, nicroly or a combination thereof, to accommodate the thermal load. The end cap incorporates a relief 72 which closely receives the bleed disc securing the disc between a first land 74 in the relief and a second land 76 on a cylindrical sleeve 78. A ring seal 80 provides secondary sealing of the end cap to the sleeve. The sleeve, which also supports the resonance cavities in center bore 82, is fabricated from SS316 in lengths for various embodiments to accommodate the resonance cavity lengths previously described. Bolts 84 extend through the end cap and sleeve into threaded receivers 86 in the body securing the components of the system together.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A gaseous oxygen resonance igniter comprising:

a body having a first inlet for gaseous oxygen, the inlet incorporating a supersonic nozzle, and an outlet incorporating an orifice of predetermined size to maintain a desired pressure in the body, the body further having an aperture opposite the first inlet;

a ceramic resonance cavity engaged at a first end in the aperture of the body;

a ceramic bleed disc engaged at a second end of the resonance cavity;

an end cap having a plenum adapted to receive high temperature oxygen flow from the resonance cavity through the bleed disc and having an exhaust port connected to the plenum; and, means for mixing high temperature oxygen from the exhaust port with fuel for ignition as a combustion initiation torch.

2. A gaseous oxygen resonance igniter as defined in claim 1 further comprising a sleeve intermediate the body and the plenum having a bore in which the ceramic resonance cavity is received.

3. A gaseous oxygen resonance igniter as defined in claim 2 further comprising a plurality of tensioning bolts securing the end cap and sleeve to the body.

4. A gaseous oxygen resonance igniter as defined in claim 3 wherein the plurality of bolts are circumferentially spaced about the resonance cavity and extend through the end cap and sleeve to be received in threaded holes in the body.

5. A gaseous oxygen resonance igniter as defined in claim 1 further comprising means for sealing the resonance cavity to the body.

6. A gaseous oxygen resonance igniter as defined in claim 2 further comprising means for sealing the resonance cavity to the sleeve.

7. A gaseous oxygen resonance igniter as defined in claim 2 wherein the ceramic bleed disc is secured intermediate the end cap the sleeve.

8. A gaseous oxygen resonance igniter as defined in claim 7 further comprising means for sealing the ceramic bleed disc to the sleeve and end cap.

9. A gaseous oxygen resonance igniter as defined in claim 2 wherein the body, sleeve and end cap are stainless steel.

10. A gaseous oxygen resonance igniter as defined in claim 9 wherein the plenum of the end cap is coated with a thermal barrier.

11. A gaseous oxygen resonance igniter as defined in claim 1 wherein the ceramic resonance cavity is aluminum silicate.

12. A gaseous oxygen resonance igniter as defined in claim 1 wherein the ceramic bleed disc is aluminum silicate.

13. A gaseous oxygen resonance igniter as defined in claim 1 wherein the ceramic for the resonance cavity is selected from the group consisting of silicon nitride, carbon/silicon carbide, aluminum silicate, glass-mica, aluminum/zirconia, and mullite.

14. A gaseous oxygen resonance igniter as defined in claim 1 wherein the ceramic for the bleed disc is selected from the group consisting of silicon nitride, carbon/silicon carbide, aluminum silicate, glass-mica, aluminum/zirconia, and mullite.

15. A gaseous oxygen resonance igniter as defined in claim 1 wherein the mixing means comprises a pilot mixing chamber connected to the exhaust port and having a reactant supply port for mixing fuel with the oxygen and an exhaust orifice for a pilot torch and further comprising a reactant source.

16. A gaseous oxygen resonance igniter as defined in claim 15 further comprising:

a second mixing chamber connected to the body outlet to receive oxygen flow and connected to the exhaust orifice to receive the pilot torch; and a reactant manifold connected to the second mixing chamber for introduction of fuel for mixture with the oxygen.

17. A gaseous oxygen resonance igniter as defined in claim 15 wherein the fuel is selected from hydrogen, methane, ethane and propane.

18. A gaseous oxygen resonance igniter as defined in claim 15 wherein the fuel is a hydrocarbon fuel.

19. A gaseous oxygen resonance igniter as defined in claim 16 wherein the fuel is selected from hydrogen, methane, ethane and propane.

20. A gaseous oxygen resonance igniter as defined in claim 16 wherein the fuel is a hydrocarbon fuel.

* * * * *